US006588623B2

(12) United States Patent
Falcaro

(10) Patent No.: US 6,588,623 B2
(45) Date of Patent: Jul. 8, 2003

(54) CONTAINER CARRIER

(76) Inventor: Steve Falcaro, 1741 Braman, Ft. Myers, FL (US) 33901

( * ) Notice: Subject to any disclaimer, the term of this patent is extended or adjusted under 35 U.S.C. 154(b) by 0 days.

(21) Appl. No.: 09/952,021

(22) Filed: Sep. 13, 2001

(65) Prior Publication Data

US 2002/0050495 A1 May 2, 2002

Related U.S. Application Data

(60) Provisional application No. 60/232,494, filed on Sep. 13, 2000.

(51) Int. Cl.[7] ..... B65D 23/10

(52) U.S. Cl. ..... 220/758; 215/396; 220/759; 294/28; 294/86.29

(58) Field of Search ..... 215/395, 396; 220/758, 759; 24/489, 517, 518; 294/31.2, 86.29, 87.22, 104, 90; 248/74.1

(56) References Cited

U.S. PATENT DOCUMENTS 234,799 A * 11/1880 Neely ..... 138/99
1,021,984 A * 4/1912 Holmes ..... 294/90
2,325,841 A * 8/1943 Faber ..... 294/31.2
2,433,037 A * 12/1947 Ferris ..... 294/163
2,610,081 A * 9/1952 Bushman ..... 294/28
3,320,958 A * 5/1967 Nolan ..... 606/158
3,330,354 A * 7/1967 Chamblee ..... 166/313
4,768,403 A * 9/1988 Bar-Noy ..... 81/3.15
5,188,266 A * 2/1993 Loulias ..... 224/148.6
5,480,204 A 1/1996 Erickson
5,577,647 A * 11/1996 Pittarelli et al. ..... 224/148.6
5,601,324 A * 2/1997 Purcell ..... 294/31.2
5,957,513 A 9/1999 Merritt

* cited by examiner

*Primary Examiner*—Stephen P. Garbe
*Assistant Examiner*—Joseph C. Merek
(74) *Attorney, Agent, or Firm*—Hahn, Loeser & Parks LLP; Laura G. Barrow

(57) ABSTRACT

The present invention is directed to a novel device for carrying a large container such as a water cooler bottle. The device comprises a collar with two pivotly connected jaws configured to engage the neck of a water cooler bottle. A handle is secured to the collar such that when the collar is engaged around the neck of the bottle, the bottle may more easily lifted by a person and carried to another location.

11 Claims, 7 Drawing Sheets

CONTAINER CARRIER

This application claims the benefit of the filing of co-pending U.S. Provisional Application No. 60/232,494, filed Sep. 13, 2000 and which is incorporated by reference herein in its entirety.

BACKGROUND AND SUMMARY OF THE INVENTION

The present invention is directed to a device for aiding in the lifting and carrying of containers, including large water cooler bottles designed for dispensing drinking water.

Typical commercial water cooler bottles are about 19 liters. Consequently, when filled, the bottle is somewhat heavy and cumbersome to carry and lift. In fact, it is not uncommon for these bottles to be dropped by delivery man and customers alike when carried any distance at all. The present invention is directed to a container carrier that can be easily secured to a container, such as a water bottle, to aid in the carrying and lifting of the container.

DETAILED DESCRIPTION OF THE PREFERRED EMBODIMENTS

Figure 1:
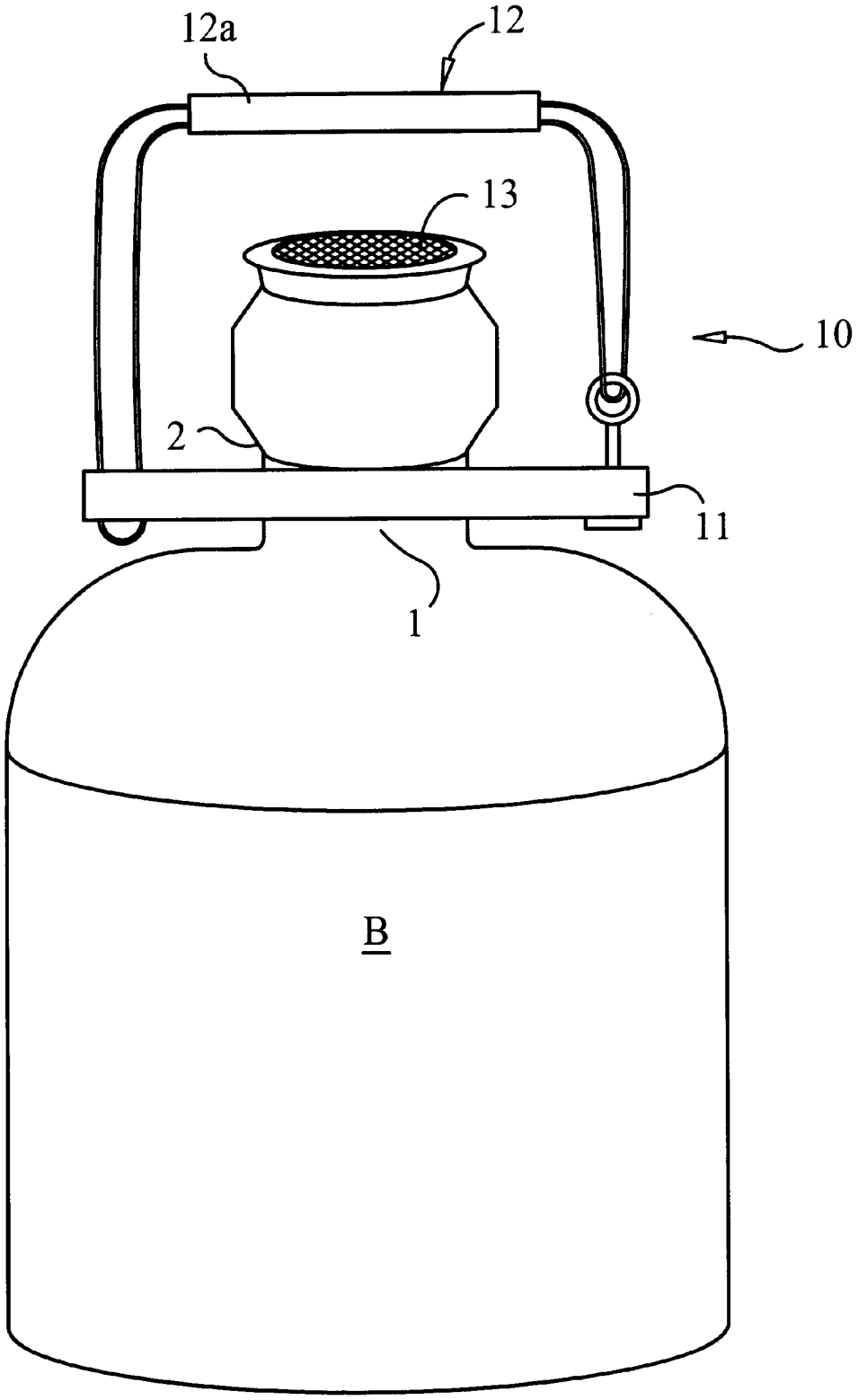
FIG. 1 is a perspective view of the inventive container carrier secured to the neck of a container such as a water cooler bottle.
Figure 2:
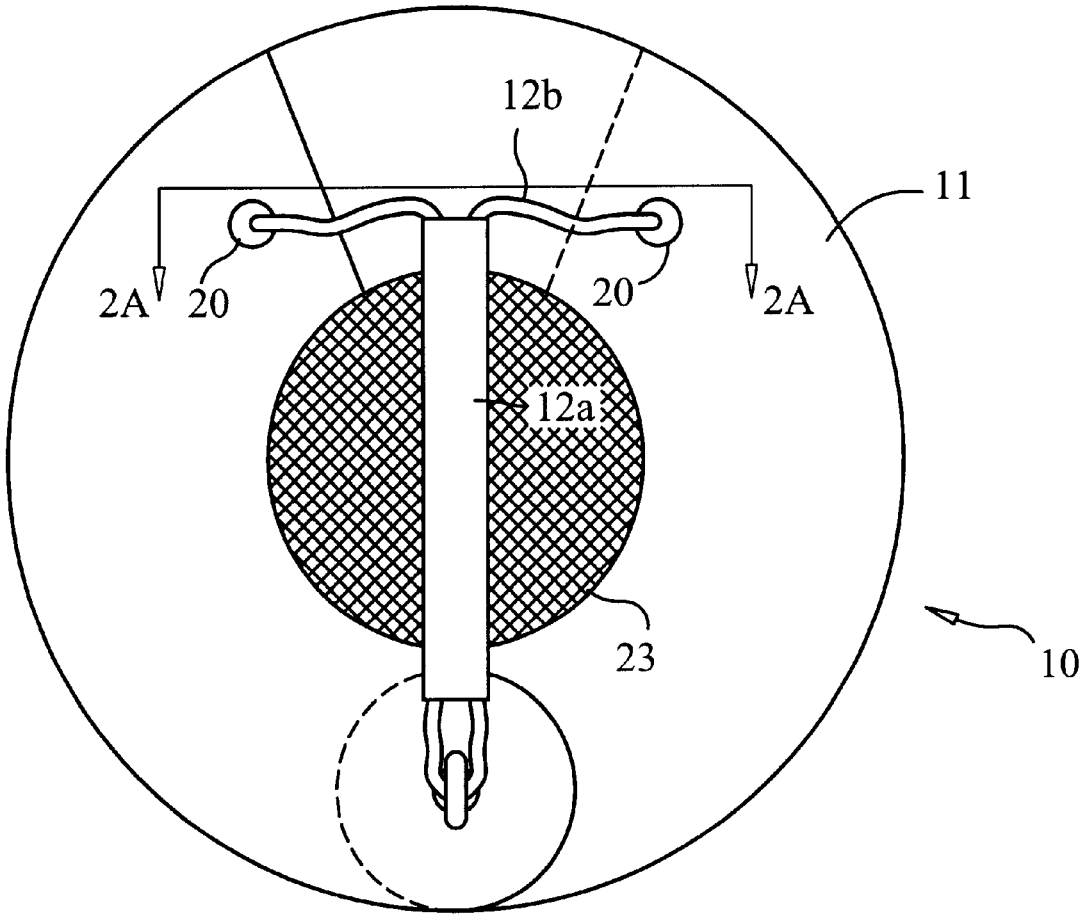
FIG. 2 is a top view of one embodiment of the inventive container carrier in the closed position.
Figure 3:
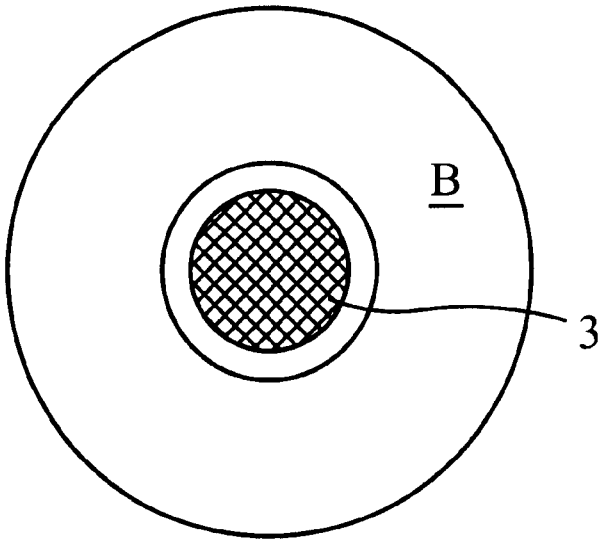
FIG. 3 is a top view of the water cooler bottle and one embodiment of the inventive carrier (without the strap for ease of illustration) in the opened position.
Figure 3:
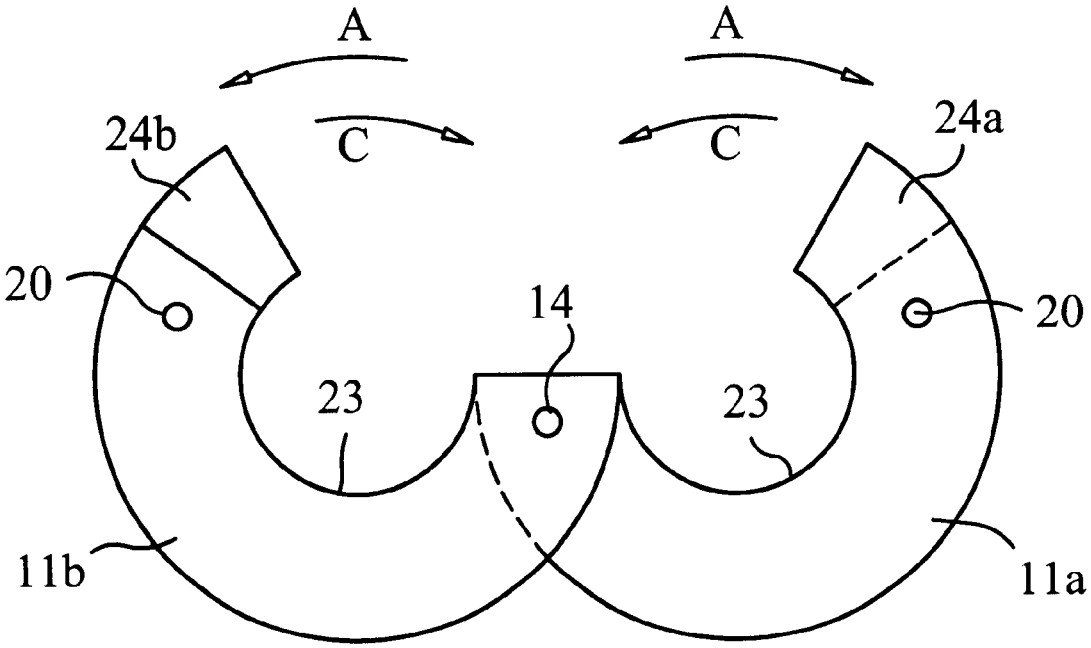
Figure 4:
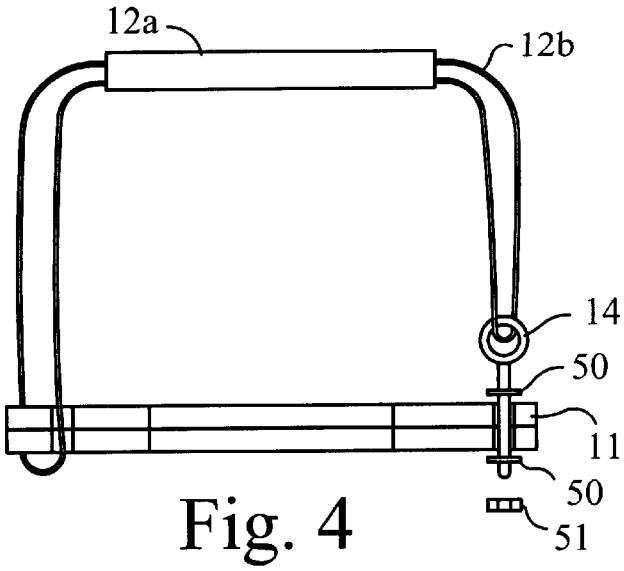
FIG. 4 is a partial cross-sectional side view of a container carrier in the closed position.

Referring now to FIGS. 1–4, the present invention is directed in certain aspects to a container carrier (10) comprising a collar (11) and a handle (12). The collar (11) further comprises two jaws (11*a,* 11*b*) that are pivotally secured to one another. As shown in FIGS. 2B and 3, an exemplary means for securing the two collar jaws (11*a,* 11*b*) comprises employment of a pivot bolt (14). The pivot bolt (14) allows the two collar jaws to pivot about the bolt (14) as shown to "open" and "close" the collar. Those of ordinary skill in the art, having the benefit of the teachings of the art and this disclosure, will recognize that other means for pivotally securing the two collar jaws together may be employed and thus are within the scope of the present invention. A preferred pivot bolt, however, is an eye bolt to which one end of the container carrier handle (12) may be secured, as discussed in more detail below. FIG. 4 illustrates an eyebolt (14) engaged within the collar and secured thereto by a washer (50) and locknut (51) assembly.

To secure the collar (11) to the container (B), the collar (11) is opened as shown in FIG. 3 by rotating the two collar jaws (11*a,* 11*b*) about the pivot bolt (14) in the direction of arrows A. The collar is then positioned around the neck (1) of the container just beneath the lip (2) (if present) of the neck. The collar is "closed" by moving the two collar jaws (11*a,* 11*b*) towards one other about the pivot bolt in the direction of arrows C. Each collar jaw comprises a recessed end (24*a,* 24*b*) opposite the pivot bolt, as more clearly illustrated in FIG. 2A. Specifically, the recessed end (24*a*) of one collar jaw (11*a*) is configured to mate with the complementarily-shaped recessed end (24*b*) of the other collar jaw (11*b*). When the collar is closed about the container neck, the inner edge (23) of the collar is frictionally engaged about the neck (1) of the container (B).

Figure 2A:
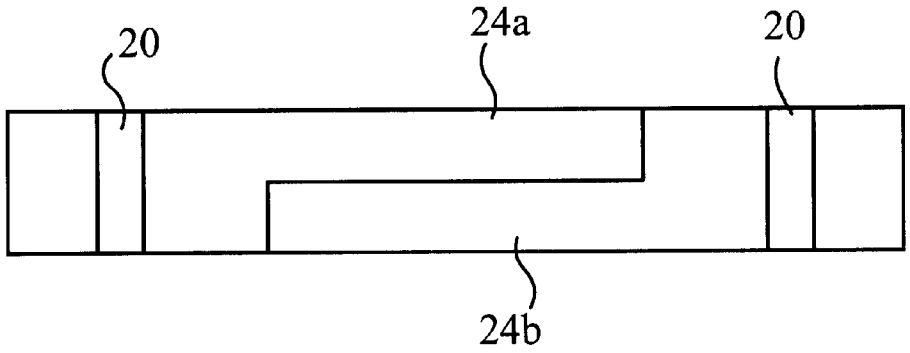
FIG. 2A is a partial side view taken along lines 2A—2A of FIG. 2 showing the mated recessed ends of the collar jaws.

To lift the container (B), the container carrier includes a handle (12) secured to the collar. An exemplary handle is illustrated in FIGS. 1–2 and 4 wherein the handle includes a hand grip (12*a*) and a strap (12*b*) threaded through an inner channel (not shown) disposed through the hand grip (12*a*). Alternatively, the two separate straps may be secured to each end of the hand grip. [For ease of explanation, the remaining disclosure of the handle will refer to the use of a single strap threaded through the handle grip.] One end of the strap is preferably secured to the pivot bolt (14), as shown. The other end of the strap is looped through the two bores (20) positioned near the recessed ends (24) of the collar jaws (11*a,* 11*b*). The collar (11) is self-tightening, for as the handle (12) is pulled upward to lift the container, the strap end threaded through the collar bores (20) consequently pulls the two collar jaws (11*a,* 11*b*) together, thereby firmly engaging the recessed ends (24) of the collar jaws to one another.

Figure 7:
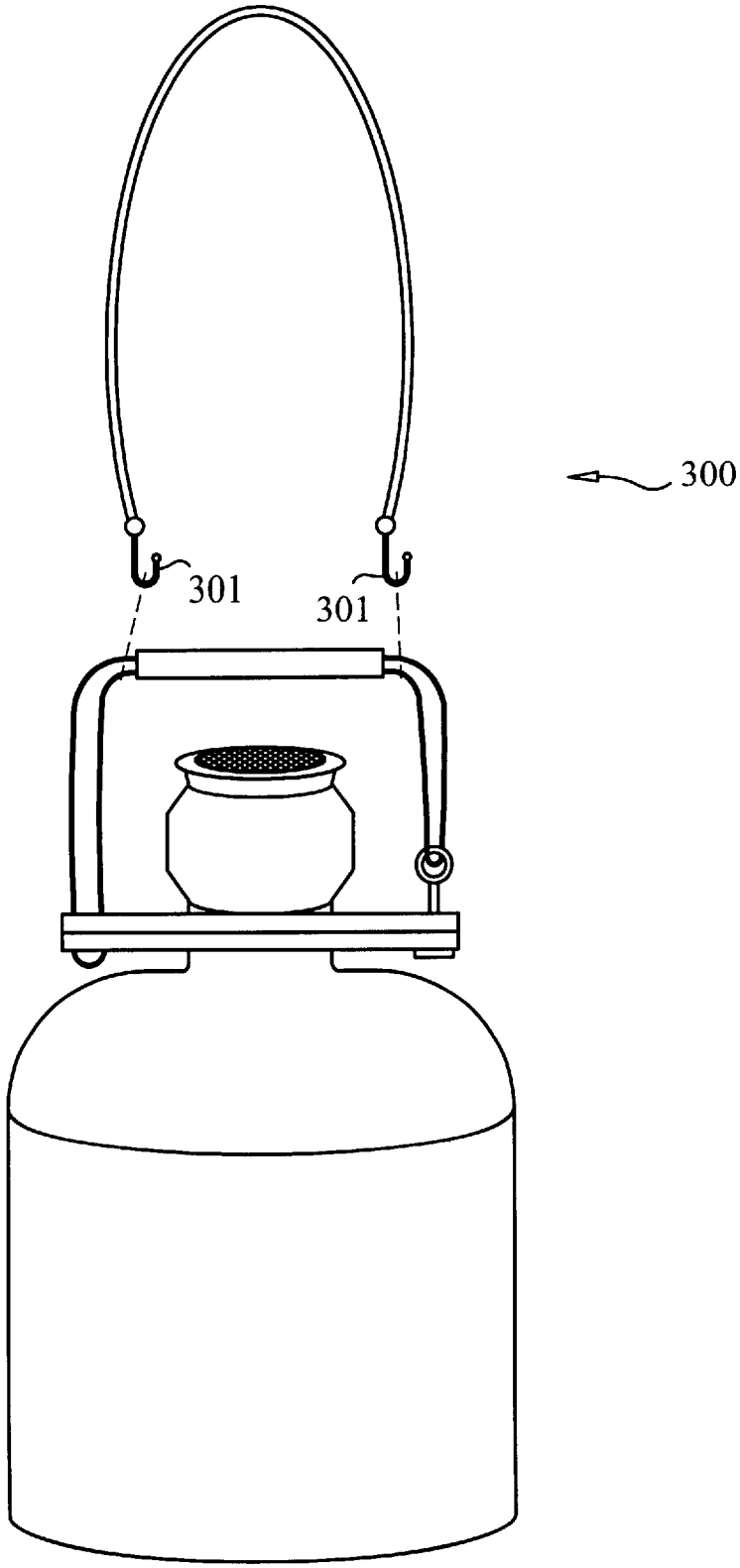
FIG. 7 is a perspective view of the container carrier attached to a container, illustrating an optional shoulder strap attachment.

FIG. 7 further illustrates a shoulder strap (300) that may be fastened to the handle (12) if desired. In this embodiment, the shoulder strap comprises hooks (301) secured to each end of the shoulder strap and are configured to engage the handle as shown.

Figure 5:
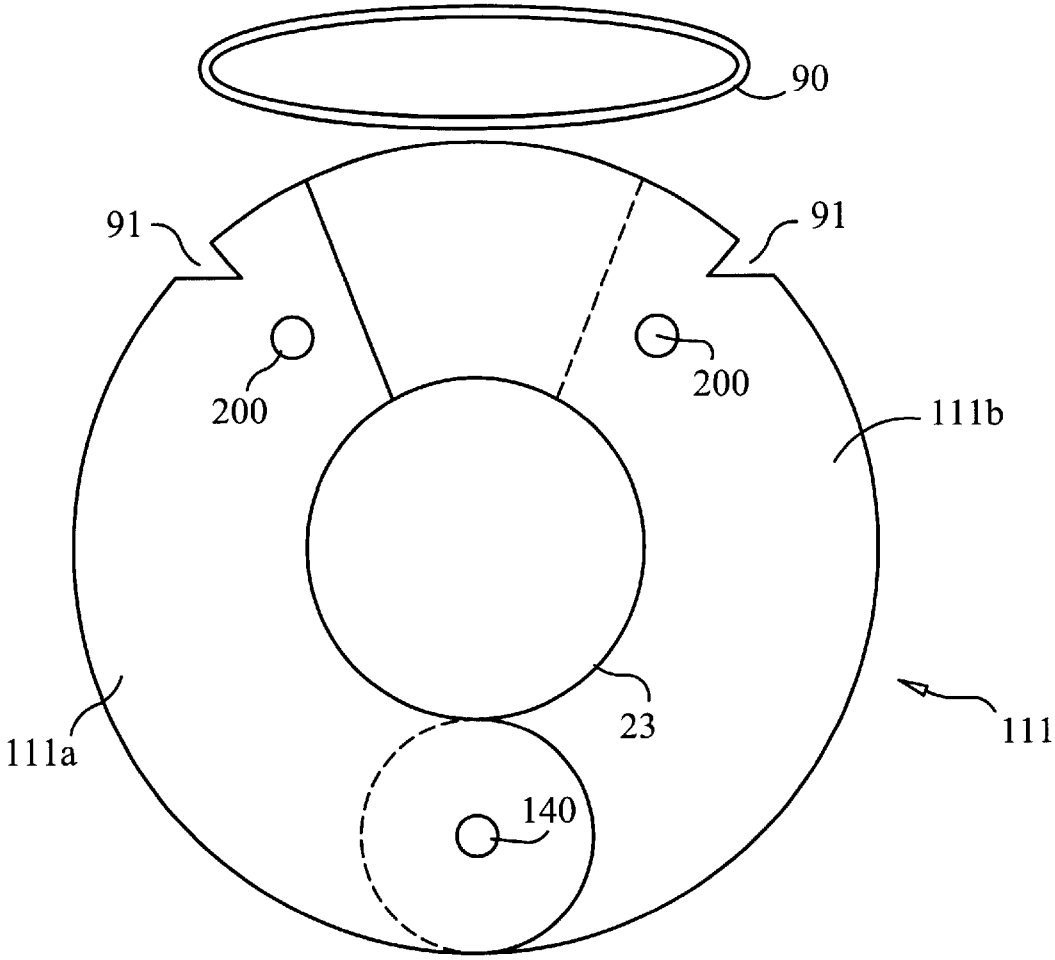
FIG. 5 is a top view of a collar, in the closed position, of a second embodiment of the inventive container carrier.
Figure 6:
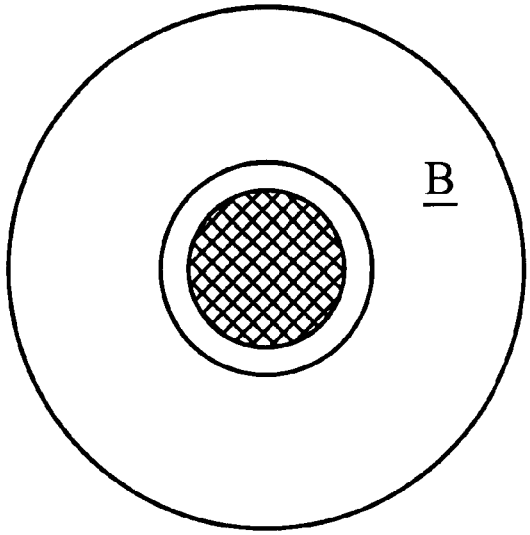
FIG. 6 is a top view of the water cooler bottle and a second embodiment of the inventive carrier (without the strap for ease of illustration) in the opened position.
Figure 6:
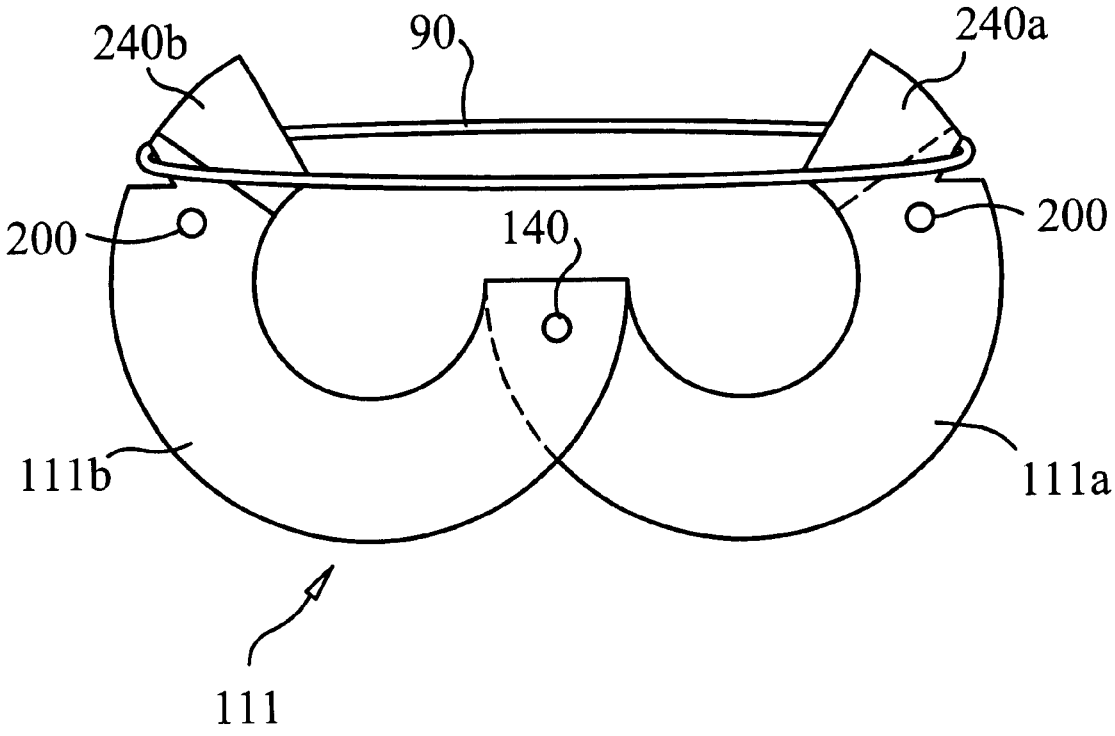

FIGS. 5–6 illustrate another embodiment of the present invention wherein an elastomeric band (90), such as a conventional rubber band, for example, is employed to improve the engagement of the collar about the container neck. Specifically, each collar jaw (111*a,* 111*b*) contains a notch (91) for securing an end of the rubber band (90). When the collar (111) is closed about the container neck, the band is "hooked" into each notch (91) to pull the two recessed ends (240*a,* 240*b*) of the respective collar jaws together more tightly for a more secure engagement. This design provides an even greater fit about the container neck, thereby further minimizing the risk of the container slipping through the collar and breaking. Moreover, in this embodiment, the handle straps could be secured to other areas of the collar jaws as opposed to being secured in close proximity (via bores 200, for example) to the recessed ends (240), as illustrated herein. Note that like the collar (11) described above for the first embodiment (FIGS. 1–3), the collar (111) in the second embodiment may employ a pivot bolt (140) for pivotally securing the two collar jaws (111*a,* 111*b*).

Figure 8:
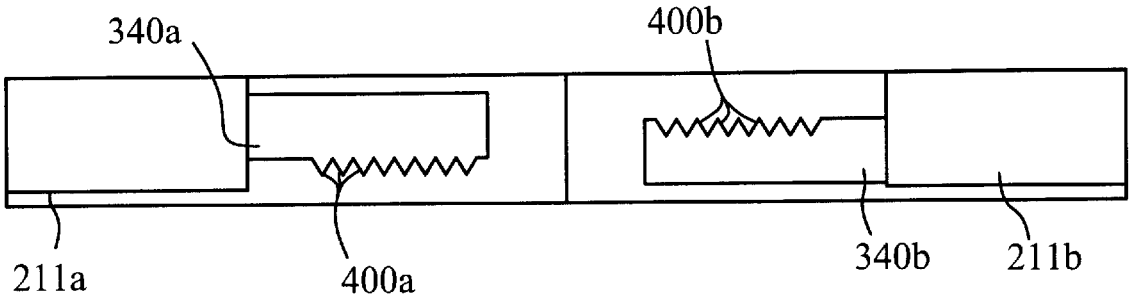
FIG. 8 is a side view of the inventive container carrier illustrating a tooth-shaped configuration for the recessed mating ends of the collar jaws of the container collar.

FIG. 8 is a side view of the inventive collar in the opened position showing another design for the mating recessed ends (340*a,* 340*b*) of the collar jaws (211*a,* 211*b*). Specifically, the recessed end of each collar jaw comprises a set of teeth (400*a*) configured for interlocking engagement with the complementarily-configured set of teeth (400*b*) of the opposite collar jaw. Such a design provides an even more secure interlocking engagement of the collar about the neck of the container when in use.

The present invention works particularly well with conventional 19-liter water cooler bottles. As illustrated in the figures, most commercial water cooler bottles include a lip (2) about the narrow neck (1) of the container. The collar of the present invention, when pulled upward by the handle attached thereto, is further maintained about the neck of the container by abutting against the lip (1), thereby minimizing the risk that the collar will slip off the container. Nevertheless, when the inner diameter of the collar portion, in the closed position, is designed to more closely approximate the outer diameter of the container neck, the presence of a diminutive lip (or lack of a lip altogether) on the container neck is of little consequence.

The collar and handle grip are preferably fabricated of a sturdy metal, wood, or plastic material.

The foregoing disclosure and description of the invention are illustrative and explanatory thereof, and various changes in the size, shape, and materials, as well as in the details of the illustrated construction may be made without departing from the spirit of the invention even though such variations were not specifically discussed above.

I claim:

1. A device for carrying containers, said device comprising:

a) a collar having two arcuate jaws pivotly connected to one another by a fastener secured thereto at a first end of each of said jaws;

b) said jaws further having second ends, each of said second ends having a recessed portion to complementarily engage one another when said collar is in a closed position;

c) each of said jaws having a first bore penetrating therethrough, said first bore positioned near said second end of each of said jaws; and d) a handle comprising a strap secured, at one end, to said fastener, said strap further housed within each of said first bores at an opposite end of said strap, such that after said collar is placed around a neck portion of a container in said closed position and said strap is pulled upward to lift said container, said collar jaws are pulled together, thereby firmly engaging said recessed ends of said collar jaws to one another.

2. The device of claim 1, wherein said fastener is housed within a second bore contained within each of said jaws, each of said second bores located in registration within one another.

3. The device of claim 1, wherein each of said second ends of said jaws include a set of teeth configured for interlocking engagement with one another.

4. The device of 3, wherein said fastener is housed within a second bore contained within each of said jaws, each of said second bores located in registration within one another.

5. The device of claim 1, wherein said fastener is a pivot bolt.

6. The device of claim 5, wherein each of said second ends of said jaws include a set of teeth configured for interlocking engagement with one another.

7. A device for carrying containers, said device comprising:

a) a collar having two arcuate jaws pivotly connected to one another at a first end of each of said jaws, b) said jaws further having second ends complementarily configured to engage one another when said collar is in a closed position;

c) said jaws having an outer edge;

d) a notch located on said outer edge of each of said jaws near the second of end of each of said jaws;

e) an elastomeric band secured to each notch of said collar; and f) a handle secured to said collar and designed for carrying a container when said collar is engaged around a neck portion of a container.

8. The device of claim 7, wherein said second ends of said jaws each comprise a recessed portion complementarily configured to engage one another.

9. The device of claim 8, wherein each of said jaws has a first bore penetrating therethrough, said first bore positioned near said second end of each of said jaws, and wherein said handle comprises a strap secured, at one end, to a fastener pivotly securing said jaws to one another at said first end of each of said first jaws, said strap further housed within each of said first bores at an opposite end of said strap, such that after said collar is placed around a neck portion of a container in said closed position and said strap is pulled upward to lift said container, said collar jaws are pulled together, thereby firmly engaging said recessed ends of said collar jaws to one another.

10. The device of claim 8, wherein each of said second ends of said jaws include a set of teeth configured for interlocking engagement with one another.

11. The device of claim 9, wherein each of said second ends of said jaws include a set of teeth configured for interlocking engagement with one another.

* * * * *